US007389615B1

(12) United States Patent
Kelley

(10) Patent No.: US 7,389,615 B1
(45) Date of Patent: Jun. 24, 2008

(54) FRICTION COMPRESSION BRACE SYSTEM

(76) Inventor: Paul J. Kelley, 17999 Sailfish Dr., Lutz, FL (US) 33559

( * ) Notice: Subject to any disclaimer, the term of this patent is extended or adjusted under 35 U.S.C. 154(b) by 334 days.

(21) Appl. No.: 11/388,136

(22) Filed: Mar. 23, 2006

Related U.S. Application Data

(60) Provisional application No. 60/702,852, filed on Jul. 28, 2005.

(51) Int. Cl.

| | |
|---|---|
| ***E06B 3/26*** | (2006.01) |
| ***E06B 3/28*** | (2006.01) |
| ***E06B 3/68*** | (2006.01) |
| ***E06B 7/00*** | (2006.01) |
| ***E06B 9/01*** | (2006.01) |
| ***E06B 3/32*** | (2006.01) |
| ***E06B 5/00*** | (2006.01) |
| ***E06B 5/10*** | (2006.01) |
| ***A47F 5/08*** | (2006.01) |
| ***E04B 1/00*** | (2006.01) |
| ***E04G 21/00*** | (2006.01) |
| ***E04G 23/00*** | (2006.01) |
| ***E05B 65/04*** | (2006.01) |
| ***E05C 7/02*** | (2006.01) |
| ***E05C 21/02*** | (2006.01) |

(52) U.S. Cl. ..... 52/202; 52/203; 52/741.3; 52/745.15; 49/50; 49/57; 49/62; 49/463; 49/465; 109/58; 109/58.5; 248/231.9; 292/32; 292/34; 292/35; 292/36; 292/37

(58) Field of Classification Search ..... 52/202, 52/203, 171.1, 741.3, 745.15; 49/50, 57, 49/62, 463, 465; 109/58, 58.5, 59 R; 248/200.1, 248/231.9; 292/32–37
See application file for complete search history.

(56) References Cited

U.S. PATENT DOCUMENTS

| | | | |
|---|---|---|---|
| 3,779,175 | A | 12/1973 | Wallen, Sr. |
| 6,219,978 | B1 | 4/2001 | Wood |
| 6,330,768 | B1 | 12/2001 | Rodrigues |
| 6,910,312 | B2 | 6/2005 | Whitworth |

*Primary Examiner*—Brian Glessner
*Assistant Examiner*—Branon C Painter
(74) *Attorney, Agent, or Firm*—Edward P Dutkiewicz

(57) ABSTRACT

A sheet is removably positionable adjacent to a window. The sheet has upper, lower and side edges. A plurality of braces is secured to the sheet. Each brace has a metal base plate and a pair of fixed housings. A vertical push rod is slidably supported in each fixed housing for axial reciprocation. A cam is rotatably secured in each fixed housing. A swivel rod is secured to the handle and both of the cams. A reciprocable housing has an open upper face and a lower face. The housing is secured to the push rods. A rubber bumper is secured to the upper face. The bumper is adapted to contact an adjacent surface when in the extended operative orientation during operation and use.

4 Claims, 7 Drawing Sheets

FRICTION COMPRESSION BRACE SYSTEM

RELATED APPLICATION

This U.S. Non-Provisional Patent Application is based upon U.S. Provisional Patent Application Ser. No. 60/702,852 filed Jul. 28, 2005, the subject matter of which is incorporated herein by reference.

BACKGROUND OF THE INVENTION

1. Field of the Invention

The present invention relates to a friction compression brake system and more particularly pertains to protecting windows from damage due to natural elements including hurricanes in a safe, convenient and economical manner.

2. Description of the Prior Art

The use of brace systems of known designs and configurations is known in the prior art. More specifically, brace systems of known designs and configurations previously devised and utilized for the purpose of protecting windows from damage due to natural elements including hurricanes through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,779,175 issued Dec. 18, 1973 to Wallen relates to a Portable Locomotive Cab Storm Window. U.S. Pat. No. 6,219,978 issued Apr. 24, 2001 to Wood relates to a Device for Covering Windows and Doors During Severe Storms. U.S. Pat. No. 6,330,2001 issued Dec. 18, 2001 to Dodrigues relates to a Window Storm Panel Brace. Lastly, U.S. Pat. No. 6,910,312 issued Jun. 28, 2005 to Whitworth relates to a Storm Brace Assembly.

While these devices fulfill their respective, particular objectives and requirements, the aforementioned patents do not describe a friction compression brake system that allows protecting windows from damage due to natural elements including hurricanes in a safe, convenient and economical manner.

In this respect, the friction compression brake system according to the present invention substantially departs from the conventional concepts and designs of the prior art, and in doing so provides an apparatus primarily developed for the purpose of protecting windows from damage due to natural elements including hurricanes and the like in a safe, convenient and economical manner.

Therefore, it can be appreciated that there exists a continuing need for a new and improved friction compression brake system which can be used for protecting windows from damage due to natural elements including hurricanes in a safe, convenient and economical manner. In this regard, the present invention substantially fulfills this need.

SUMMARY OF THE INVENTION

In view of the foregoing disadvantages inherent in the known types of brace systems of known designs and configurations now present in the prior art, the present invention provides an improved friction compression brake system. As such, the general purpose of the present invention, which will be described subsequently in greater detail, is to provide a new and improved friction compression brake system and method which has all the advantages of the prior art and none of the disadvantages.

To attain this, the present invention essentially comprises a friction compression brake system. First provided is a vertical building wall. An inset vertical window is provided. The vertical window has a frame. The frame is formed of a horizontal upper surface and a horizontal lower surfaces. The frame is further formed with vertical side surfaces. The side surfaces are provided between the wall and the window.

A plywood sheet is provided. The plywood sheet is in a rectangular configuration. The plywood sheet has an exterior surface and interior surface. The plywood sheet is removably positionable adjacent to the window for covering and protection purposes. The plywood sheet has an upper edge. The upper edge is positionable adjacent to the upper surface. The plywood sheet has a lower edge. The lower edge is positionable adjacent to the lower surface. The plywood sheet further has side edges. The side edges are provided between the upper edge and the lower edge. The side edges are positionable adjacent to the side surfaces.

A pair of similarly configured, laterally spaced grips are provided next. Wood screws are provided. The wood screws secure the grips to the exterior surface of the plywood sheet in proximity to the lower edge. Each grip has a piece of soft material, preferably rubber. The material is located on the lower edge of the plywood sheet. In this manner the lower surface is secured during operation and use.

Further provided is a pair of similarly configured, laterally spaced braces. The braces are secured to the plywood sheet adjacent to the upper edge. Each brace has a metal base plate. The base plate is in a rectangular configuration. The base plate has an upper horizontal edge. The upper edge is positionable adjacent to the upper edge of the plywood sheet. The base plate has a lower horizontal edge. Vertical side edges 54 are provided between the upper and lower edge. The base plate has a pair of vertically displaced side screw holes. The base plate has a pair of vertically displaced central screw holes. Screws are provided. The screws provided for attachment to the plywood sheet. A pair of vertically oriented fixed housings are provided. Each housing is secured to the base plate between the central screw holes and the side screw holes. The base plate has an upper end and a lower end. A vertical push rod is provided. The push rod is slidably supported in each fixed housing adjacent to the upper end for axial reciprocation. A cam is provided. The cam is rotatably secured in each fixed housing adjacent to the lower end. A U-shaped swivel handle is provided. Further provided is a swivel rod. The swivel rod is secured to the handle and both of the cams. In this manner the cams may be rotated about 90 degrees. A reciprocable housing is provided. The reciprocable housing has an open upper face and a lower face. The reciprocable housing has bolts. The bolts secure the lower face to the push rods. Vertical side faces are provided between the upper and lower face. A rubber bumper is provided. The bumper is secured to the reciprocable housing. The bumper has an upwardly extending honey combed surface. The bumper is adapted to contact the upper surface when in the extended operative orientation during operation and use. The handle is adapted to be perpendicular to the plate when in the retracted inoperative orientation.

Provided last is a locking assembly. The locking assembly is formed of axially aligned bypass pin holes. The pin holes are provided through one of the fixed housings. The locking assembly has associated bypass pin hole. The pin holes are provided through the cam between the bypass pin holes. A pin is provided. In this manner when the cam is in the extended operative orientation, the pin holes will be in alignment for receiving the pin and locking the system in an extended operative orientation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved friction compression brake system which has all of the advantages of the prior art brace systems of known designs and configurations and none of the disadvantages.

It is another object of the present invention to provide a new and improved friction compression brake system which may be easily and efficiently manufactured and marketed.

It is further object of the present invention to provide a new and improved friction compression brake system which is of durable and reliable constructions.

An even further object of the present invention is to provide a new and improved friction compression brake system which is susceptible of a low cost of manufacture with regard to both materials and labor, and which accordingly is then susceptible of low prices of sale to the consuming public, thereby making such friction compression brake system economically available to the buying public.

Even still another object of the present invention is to provide a friction compression brake system for protecting windows from damage due to natural elements including hurricanes in a safe, convenient and economical manner.

Lastly, it is an object of the present invention to provide a new and improved friction compression brake system. A sheet is removably positionable adjacent to a window. The sheet has upper, lower and side edges. A plurality of braces is secured to the sheet. Each brace has a metal base plate and a pair of fixed housings. A vertical push rod is slidably supported in each fixed housing for axial reciprocation. A cam is rotatably secured in each fixed housing. A swivel rod is secured to the handle and both of the cams. A reciprocable housing has an open upper face and a lower face. The housing is secured to the push rods. A rubber bumper is secured to the upper face. The bumper is adapted to contact an adjacent surface when in the extended operative orientation during operation and use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures illustrating the primary embodiment of the invention.

DESCRIPTION OF THE PREFERRED EMBODIMENT

Figure 1:
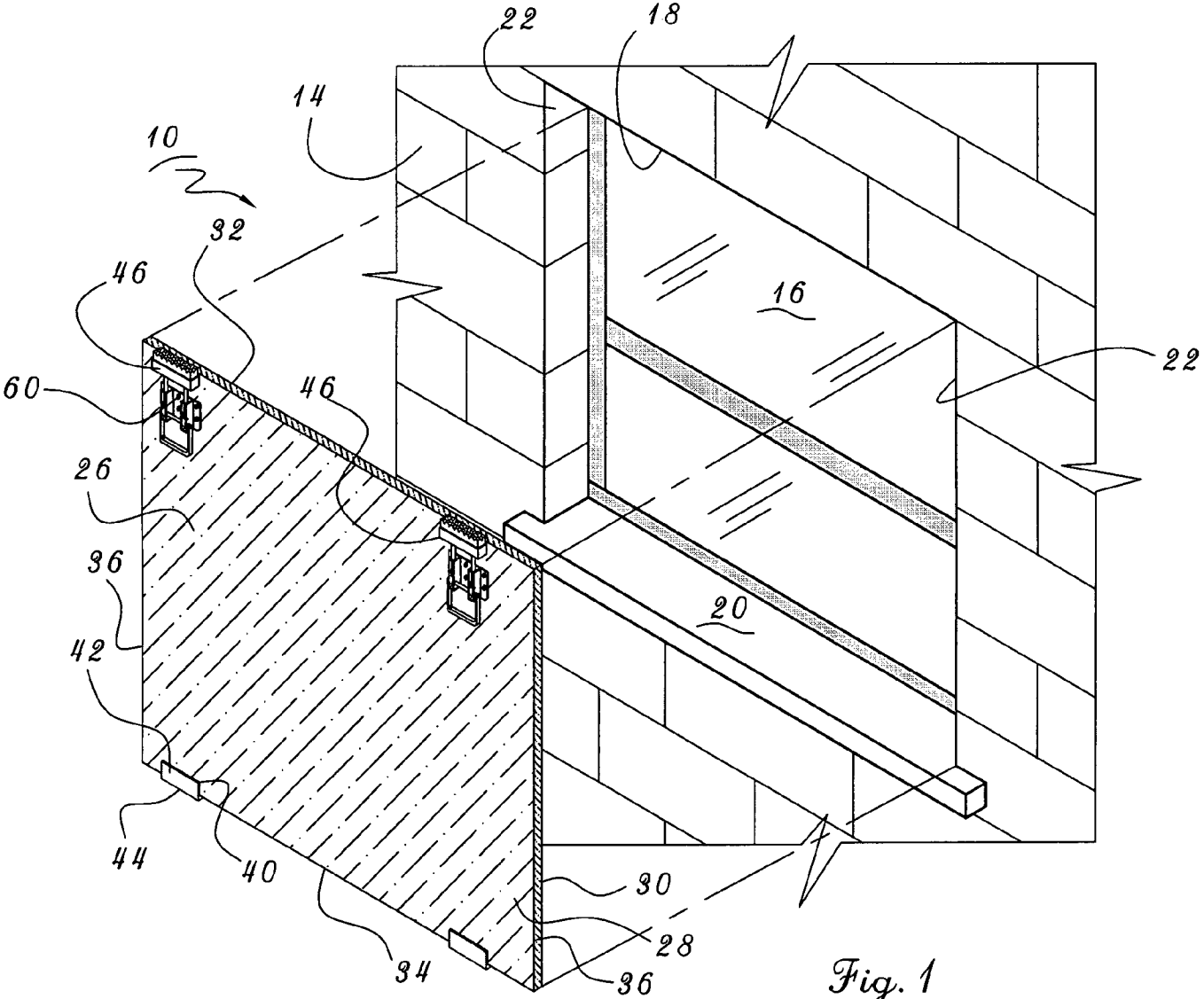
FIG. 1 is a perspective illustration of a friction compression brace system that allows protecting windows from damage due to natural elements including hurricanes constructed in accordance with the principles of the present invention.
Figure 2:
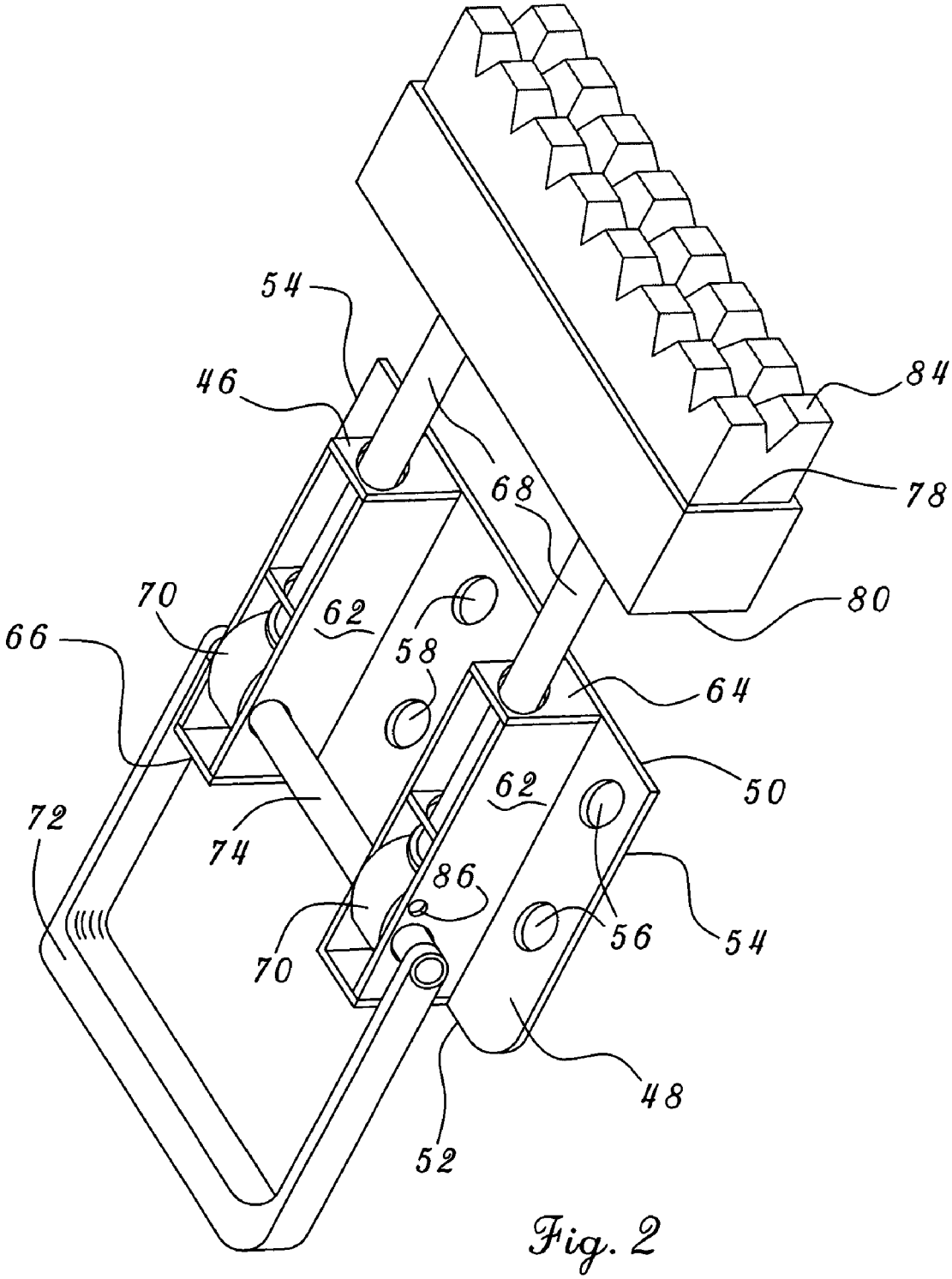
FIG. 2 is a perspective illustration of the brace of the system shown in FIG. 1 in the extended or operative orientation.
Figure 3:
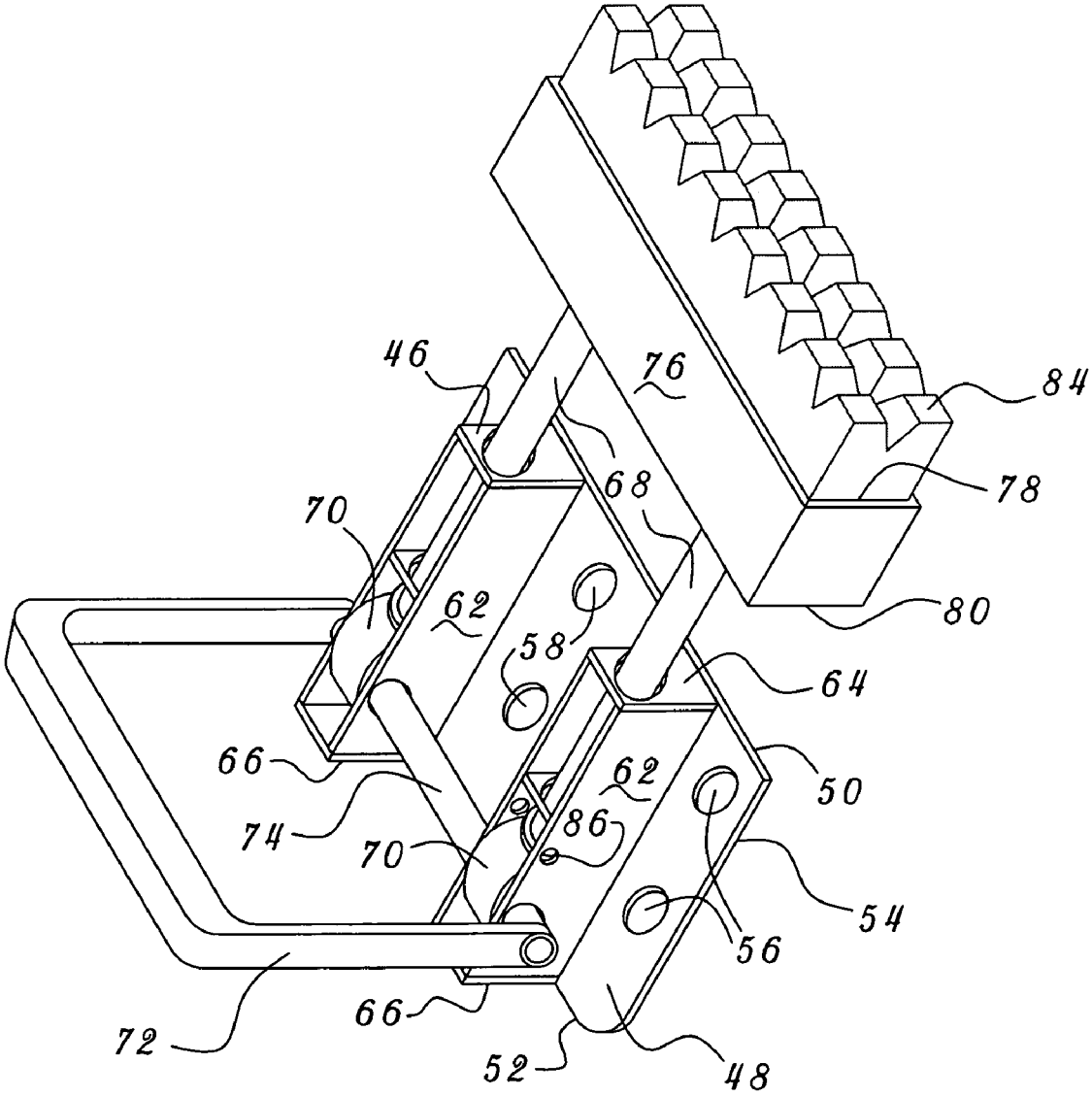
FIG. 3 is a perspective illustration of the brace shown in FIG. 2 but in the retracted or inoperative orientation.
Figure 4:
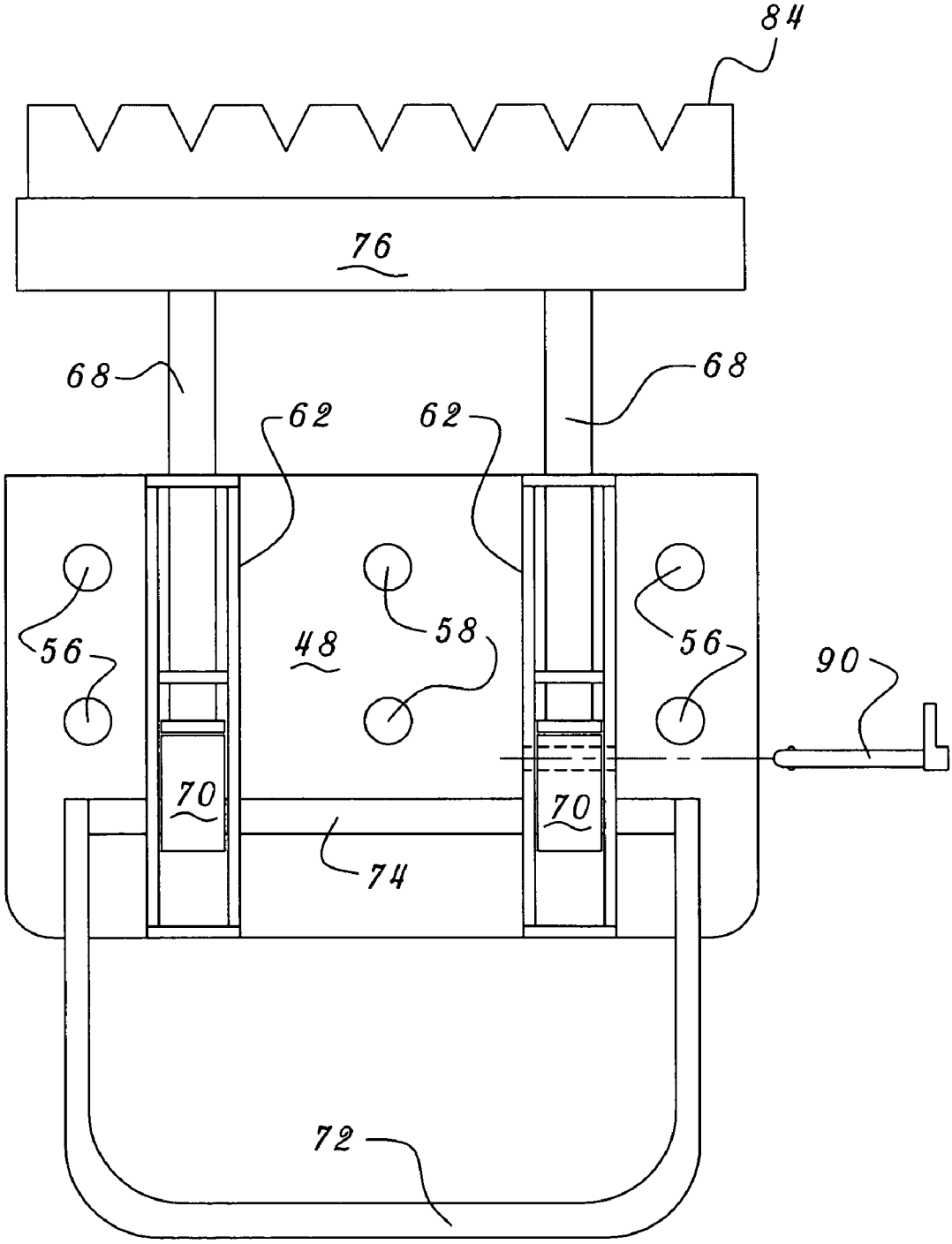
FIG. 4 is a plan view of the brace in the extended or operative orientation as shown in FIG. 2.
Figure 5:
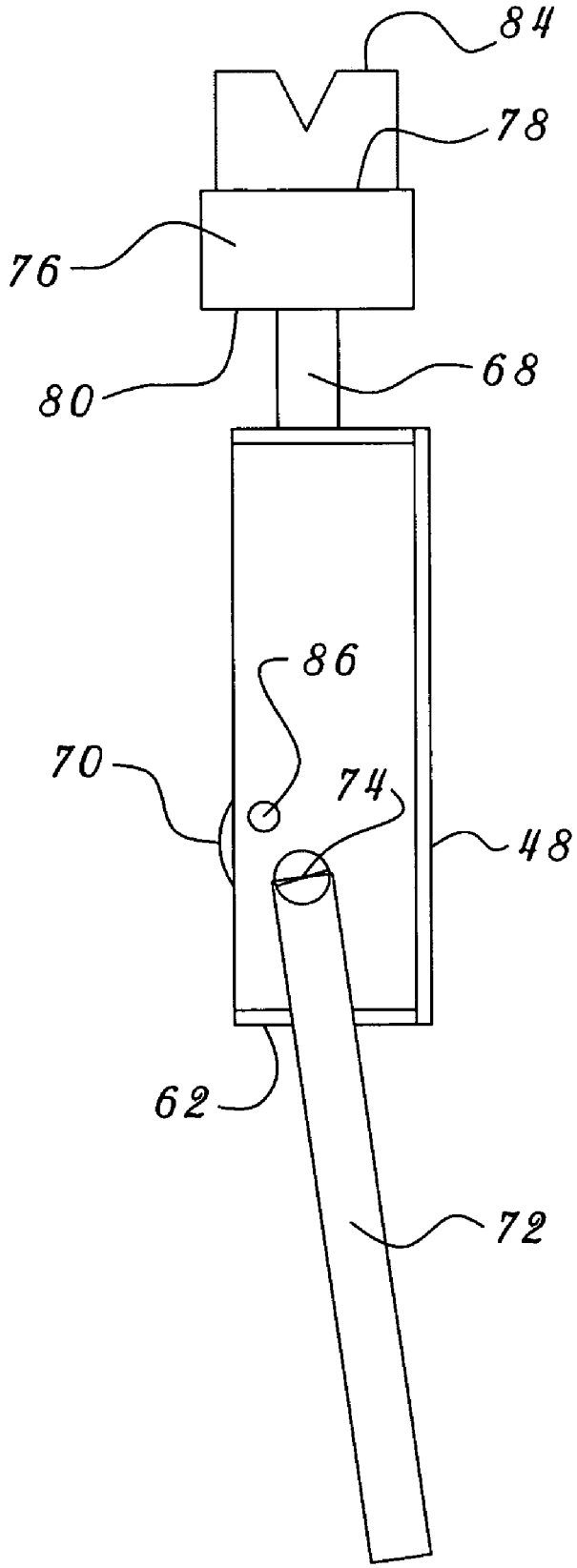
FIG. 5 is a side elevational view of the brace in the extended or operative orientation as shown in FIG. 2.
Figure 6:
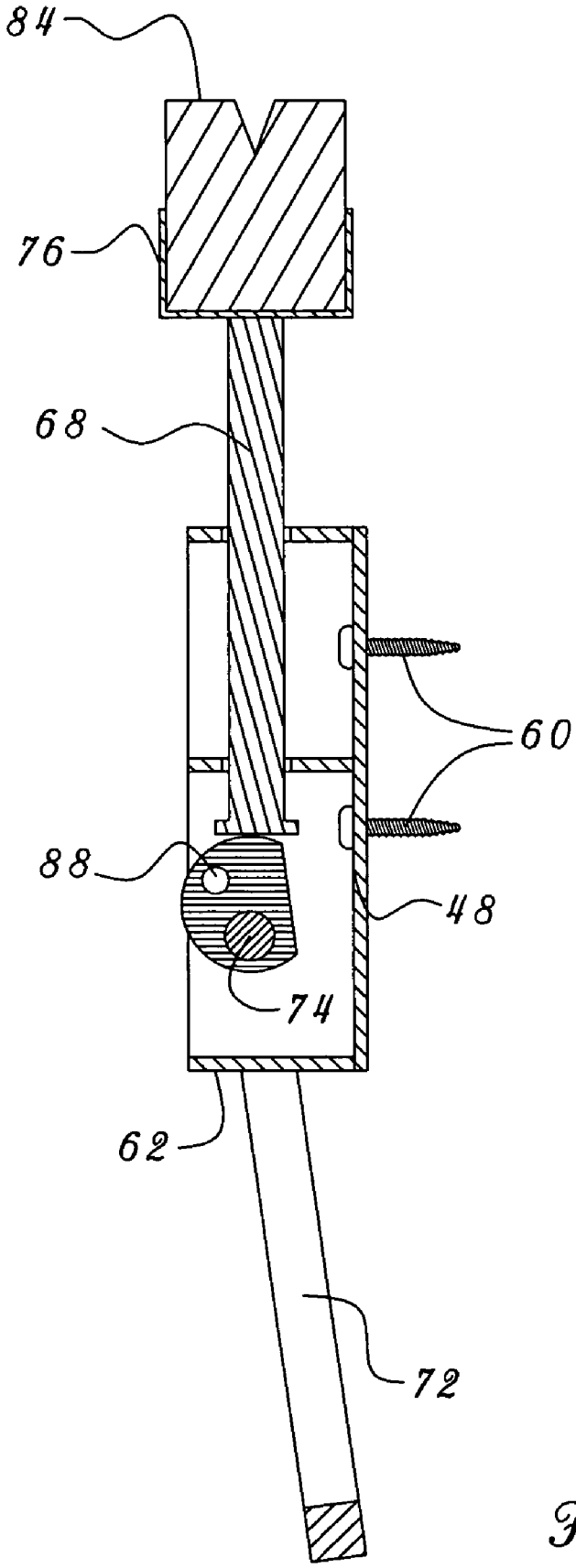
FIG. 6 is a cross sectional view through the brace of the prior Figures.
Figure 7:
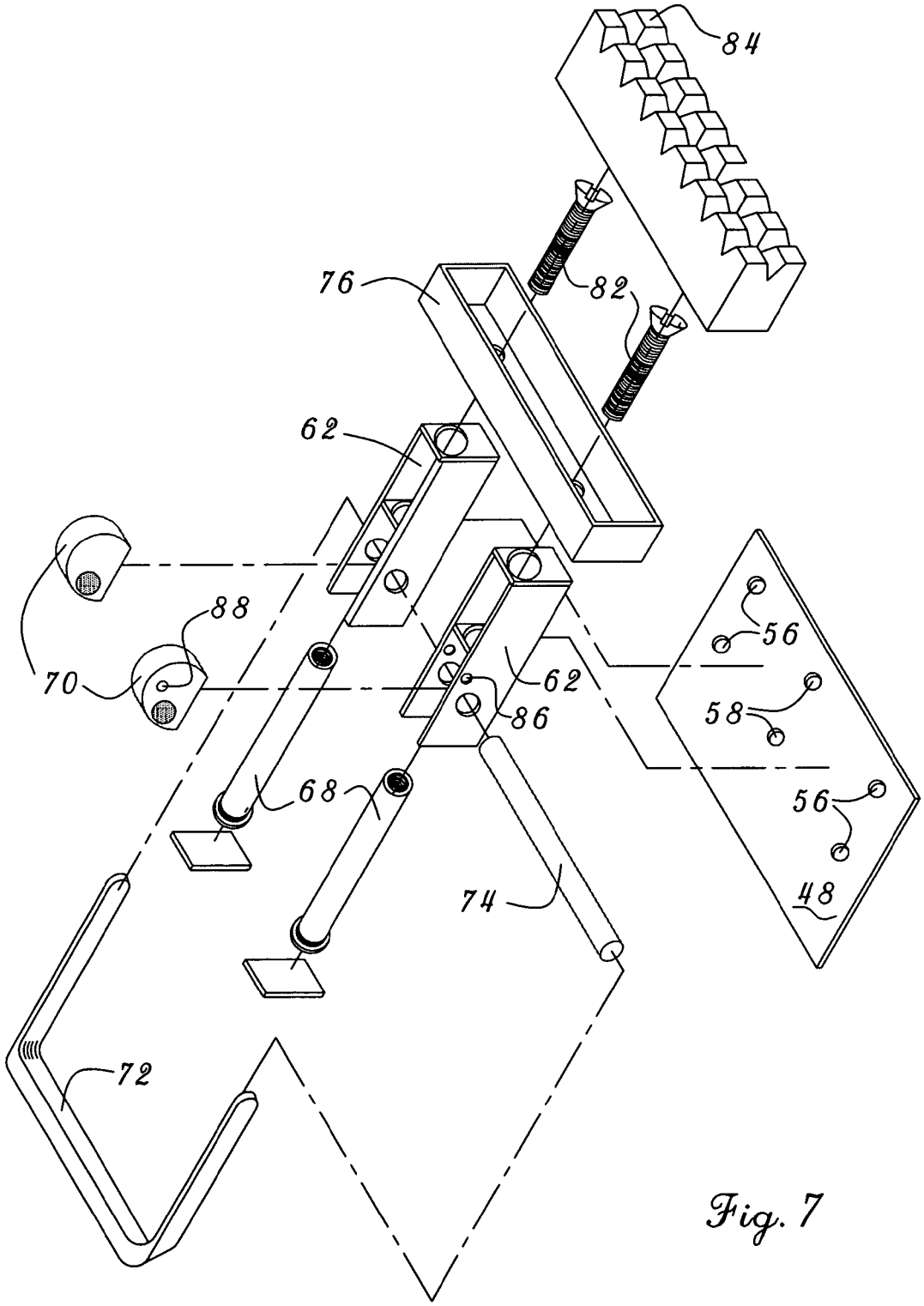
FIG. 7 is an exploded perspective illustration of the brace of the system shown in FIGS. 1-6 in the extended or operative orientation.

With reference now to the drawings, and in particular to FIG. 1 thereof, the preferred embodiment of the new and improved friction compression brake system embodying the principles and concepts of the present invention and generally designated by the reference numeral 10 will be described.

The present invention, the friction compression brake system 10 is comprised of a plurality of components. Such components in their broadest context include a sheet and a plurality of braces. Such components are individually configured and correlated with respect to each other so as to attain the desired objective.

First provided is a vertical building wall 14. An inset vertical window 16 is provided. The vertical window has a frame. The frame is formed of a horizontal upper surface 18 and a horizontal lower surfaces 20. The frame is further formed with vertical side surfaces 22. The side surfaces are provided between the wall and the window.

A plywood sheet 26 is provided. The plywood sheet is in a rectangular configuration. The plywood sheet has an exterior surface 28 and interior surface 30. The plywood sheet is removably positionable adjacent to the window for covering and protection purposes. The plywood sheet has an upper edge 32. The upper edge is positionable adjacent to the upper surface. The plywood sheet has a lower edge 34. The lower edge is positionable adjacent to the lower surface. The plywood sheet further has side edges 36. The side edges are provided between the upper edge and the lower edge. The side edges are positionable adjacent to the side surfaces.

A pair of similarly configured, laterally spaced grips 40 are provided next. Wood screws 42 are provided. The wood screws secure the grips to the exterior surface of the plywood sheet in proximity to the lower edge. Each grip has a piece of soft material 44, preferably rubber. The material is located on the lower edge of the plywood sheet. In this manner the lower surface is secured during operation and use.

Further provided is a pair of similarly configured, laterally spaced braces 46. The braces are secured to the plywood sheet adjacent to the upper edge. Each brace has a metal base plate 48. The base plate is in a rectangular configuration. The base plate has an upper horizontal edge 50. The upper edge is positionable adjacent to the upper edge of the plywood sheet. The base plate has a lower horizontal edge 52. Vertical side edges 54 are provided between the upper and lower edge. The base plate has a pair of vertically displaced side screw holes 56. The base plate has a pair of vertically displaced central screw holes 58. Screws 60 are provided. The screws provided for attachment to the plywood sheet. A pair of vertically oriented fixed housings 62 are provided. Each housing is secured to the base plate between the central screw holes and the side screw holes. The base plate has an upper end 64 and a lower end 66. A vertical push rod 68 is provided. The push rod is slidably supported in each fixed housing adjacent to the upper end for axial reciprocation. A cam 70 is provided. The cam is rotatably secured in each fixed housing adjacent to the lower end. A U-shaped swivel handle 72 is provided. Further provided is a swivel rod 74. The swivel rod is secured to the handle and both of the cams. In this manner the cams may be rotated about 90 degrees. A reciprocable housing 76 is provided. The reciprocable housing has an open upper face 78 and a lower face 80. The reciprocable housing has bolts 82. The bolts secure the lower face to the push rods. Vertical side faces are provided between the upper and lower face. A rubber bumper 84 is provided. The bumper is secured to the reciprocable housing. The bumper has an upwardly extending honey combed surface. The bumper is adapted to contact the upper surface when in the extended operative orientation during operation and use. The handle is adapted to be perpendicular to the plate when in the retracted inoperative orientation.

Provided last is a locking assembly. The locking assembly is formed of axially aligned bypass pin holes 86. The pin holes are provided through one of the fixed housings. The locking assembly has associated bypass pin hole 88. The pin holes are provided through the cam between the bypass pin holes. A pin 90 is provided. In this manner when the cam is in the extended operative orientation, the pin holes will be in alignment for receiving the pin and locking the system in an extended operative orientation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A friction compression brace system comprising:

a sheet removably positionable adjacent to a window and having an upper, lower and side edges; and a plurality of braces secured to the sheet, each brace having a metal base plate and a pair of fixed housings with a vertical push rod slidably supported in each fixed housing for axial reciprocation, a cam rotatably secured in each fixed housing and a handle with a swivel rod secured to the handle and both of the cams, a reciprocable housing having an open upper face and a lower face secured to the push rods with a rubber bumper secured to the upper face adapted to contact an adjacent surface when in the extended operative orientation during operation and use.

2. The system as set forth in claim 1 and further including:

a locking assembly formed of axially aligned bypass pin holes through a fixed housing and an associated bypass pin hole through the cam between the housing bypass pin holes whereby when the cam is in the extended operative orientation, the pin holes of the housing and the pin holes of the cam will be in alignment for receiving a pin and locking the system in an extended operative orientation.

3. The system as set forth in claim 1 wherein the sheet is a plywood sheet in a rectangular configuration with two lateral displaced braces at the upper edge of the sheet and further including two similarly configured, laterally spaced grips secured to the plywood sheet in proximity to the lower edge, each grip having a piece of soft material located on the lower edge of the plywood sheet for securement to a lower adjacent surface during operation and use.

4. A friction compression brace system for protecting windows from damage due to natural elements including hurricanes in a safe, convenient and economical manner comprising, in combination:

a vertical building wall and an inset vertical window with a frame formed of a horizontal upper surface and a horizontal lower surfaces and vertical side surfaces between the wall and the window;

a plywood sheet in a rectangular configuration having an exterior surface and interior surface removably positionable adjacent to the window for covering and protection purposes, the plywood sheet having an upper edge positionable adjacent to the upper surface and a lower edge positionable adjacent to the lower surface with side edges there between positionable adjacent to the side surfaces;

a pair of similarly configured, laterally spaced grips with wood screws securing the grips to the exterior surface of the plywood sheet in proximity to the lower edge, each grip having a piece of rubber located on the lower edge of the plywood sheet for securement to the lower surface during operation and use;

a pair of similarly configured, laterally spaced braces secured to the plywood sheet adjacent to the upper edge, each brace having a metal base plate in a rectangular configuration with an upper horizontal edge positionable adjacent to the upper edge of the plywood sheet and a lower horizontal edge with vertical side edges there between, the base plate having a pair of vertically displaced side screw holes and a pair of vertically displaced central screw holes with screws for attachment to the plywood sheet, a pair of vertically oriented fixed housings each secured to the base plate between the central screw holes and the side screw holes with an upper end and a lower end, a vertical push rod slidably supported in each fixed housing adjacent to the upper end for axial reciprocation, a cam rotatably secured in each fixed housing adjacent to the lower end and a U-shaped swivel handle with a swivel rod secured to the handle and both of the cams to rotate the cams about 90 degrees, a reciprocable housing having an open upper face and a lower face with bolts securing the lower face to the push rods with vertical side faces there between, and a rubber bumper secured to the reciprocable housing with an upwardly extending honeycombed surface adapted to contact the upper surface when in the extended operative orientation during operation and use, the handle adapted to be perpendicular to the plate when in the retracted inoperative orientation; and a locking assembly formed of axially aligned bypass pin holes through one of the fixed housings and an associated bypass pin hole through the cam between the housing bypass pin holes whereby when the cam is in the extended operative orientation, the pin holes of the housing and the pin holes of the cam will be in alignment for receiving a pin and locking the system in an extended operative orientation.

* * * * *